US012571192B2

(12) United States Patent
Ganter et al.

(10) Patent No.: US 12,571,192 B2
(45) Date of Patent: Mar. 10, 2026

(54) DRAIN AUGER CLEANING DEVICE

(71) Applicants: Mark Chase Ganter, Unity (CA); Colton Timmermans, Unity (CA)

(72) Inventors: Mark Chase Ganter, Unity (CA); Colton Timmermans, Unity (CA)

( * ) Notice: Subject to any disclaimer, the term of this patent is extended or adjusted under 35 U.S.C. 154(b) by 99 days.

(21) Appl. No.: 18/746,692

(22) Filed: Jun. 18, 2024

(65) Prior Publication Data

US 2025/0382782 A1 Dec. 18, 2025

(51) Int. Cl.
*E03C 1/304* (2006.01)

(52) U.S. Cl.
CPC ..... *E03C 1/304* (2013.01)

(58) Field of Classification Search
CPC . E03C 1/30; E03C 1/302; E03C 1/304; E03C 1/306; E03C 1/308; E03F 9/00; E03F 9/007; B08B 9/02; B08B 9/023; B65D 1/20
USPC .... 4/255.01, 255.04, 255.06, 255.07, 255.09
See application file for complete search history.

(56) References Cited

U.S. PATENT DOCUMENTS

| | | | | |
|---|---|---|---|---|
| 10,024,115 | B1 * | 7/2018 | Bollman | E21B 12/06 |
| 2021/0222412 | A1 * | 7/2021 | Emslie | E03C 1/302 |
| 2023/0149985 | A1 * | 5/2023 | Williams | E03C 1/302 15/104.095 |
| 2024/0254745 | A1 * | 8/2024 | Roman | B65D 1/20 |

FOREIGN PATENT DOCUMENTS

| | | | | |
|---|---|---|---|---|
| CN | 113502885 A | * 10/2021 | | E03C 1/304 |

* cited by examiner

*Primary Examiner* — Tuan N Nguyen
(74) *Attorney, Agent, or Firm* — Orin Del Vecchio

(57) ABSTRACT

A drain auger cleaning device that is configured to be inserted into a plumbing pipe or plumbing cleanout wherein the present invention provides cleaning of the drain auger during removal from the drain auger cleaning device. The invention includes a body having a lower portion and an upper portion. The upper portion is secured to the upper end of the lower portion and is perpendicular to the lower portion. The lower portion is cylindrical in shape having a first section and a second section that are hingedly coupled. The upper portion further includes a first section and second section separated by a center seam wherein the lower portion and upper portion of the body are hingedly movable between an open and closed position. Secured to the upper portion is a water inlet configure to be coupled to a hose to introduce water into the hollow passage of the body.

10 Claims, 2 Drawing Sheets

DRAIN AUGER CLEANING DEVICE

FIELD OF THE INVENTION

The present invention relates generally to plumbing equipment, more specifically but not by way of limitation, a cleaning device that is operably inserted into a plumbing cleanout wherein the device facilitates the cleaning of a plumbing snake as the plumbing snake is extracted from the cleanout.

BACKGROUND

Plumbing is present in all structures both residential and commercial and is employed to facilitate the distribution of water through the structure. Part of a conventional plumbing system are drain pipes. Drain pipes are positioned in various locations of the plumbing system and are operable to remove wastewater from the plumbing system into a municipal sewer or similar wastewater removal. As plumbing systems are utilized there is buildup of sludge, waste and debris in the drain pipes. This naturally occurs over time and maintenance must be performed in order to maintain proper flow through the drain pipes.

Many times, during maintenance and/or repair of drain pipe a drain auger, also known as a drain snake is utilized to clear excessive debris and sludge. As is known in the art, drain augers are most commonly manufactured from flexible metal coil wire and are inserted into the drain pipes often utilizing locations known as clean-outs. A clean-out is an access port to a drain valve and allows a plumber to insert the drain auger into the drain line and clear the drain line of the debris. One issue often encountered is the amount of sludge and debris that is collected onto the drain auger. As the auger is removed from the drain pipe, sludge and debris will often remain on the drain auger. This is undesirable as the sludge and debris can then be unintentionally spread into areas such as the interior of the structure and the tool area of the plumber.

Accordingly, there is a need for a drain auger cleaning device that provides cleaning of drain augers as the drain auger is being extracted from the plumbing cleanout.

SUMMARY OF THE INVENTION

It is the object of the present invention to provide a drain auger cleaning device that is configured to be inserted into a plumbing cleanout wherein the device of the present invention includes a body having an upper portion and a lower portion.

Another object of the present invention is to provide a cleaning device for a drain auger that cleans the drain auger during removal from a plumbing cleanout wherein the lower portion of the body is cylindrical in shape having a first section and a second section.

A further object of the present invention is to provide a drain auger cleaning device that is configured to be inserted into a plumbing cleanout wherein the first section and second section of the lower portion of the body are hingedly coupled.

Yet a further object of the present invention is to provide a cleaning device for a drain auger that cleans the drain auger during removal from a plumbing cleanout wherein the upper portion of the body is annular in shape being planar in manner.

Still another object of the present invention is to provide a drain auger cleaning device that is configured to be inserted into a plumbing cleanout wherein the upper portion of the body is perpendicular to the lower portion and has a diameter that is greater than that of the diameter of the lower portion.

An additional object of the present invention is to provide a cleaning device for a drain auger that cleans the drain auger during removal from a plumbing cleanout wherein the upper portion of the body includes a first half and a second half that are semicircular in shape.

Yet a further object of the present invention is to provide a drain auger cleaning device that is configured to be inserted into a plumbing cleanout wherein the present invention further includes a water inlet operably coupled to the upper portion of the body.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
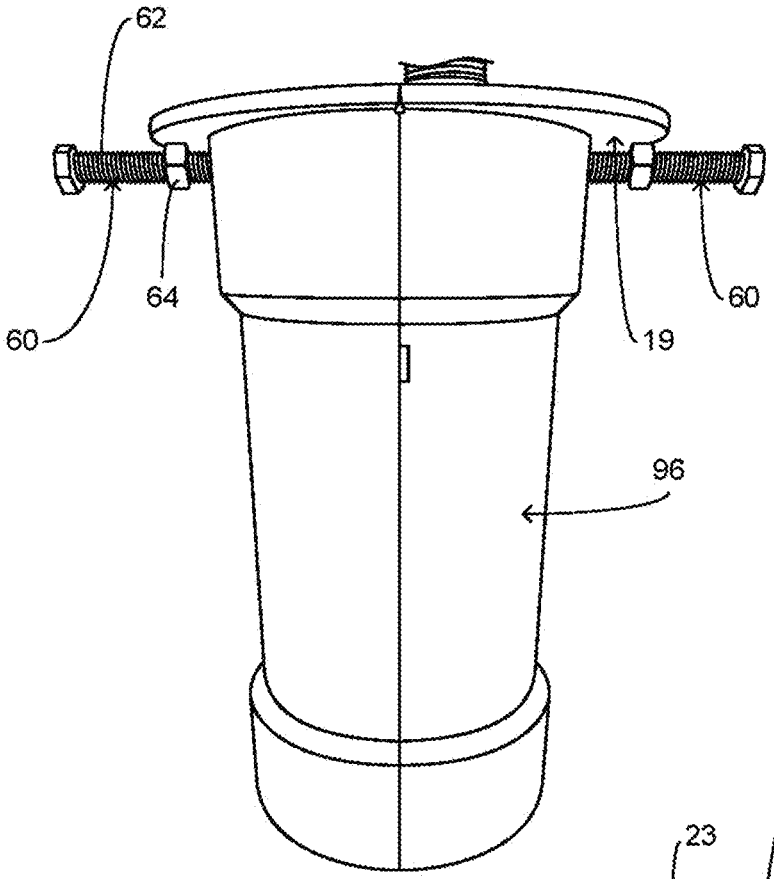
FIG. 1 is a side view of the present invention operably coupled with an exemplary pipe.
Figure 2:
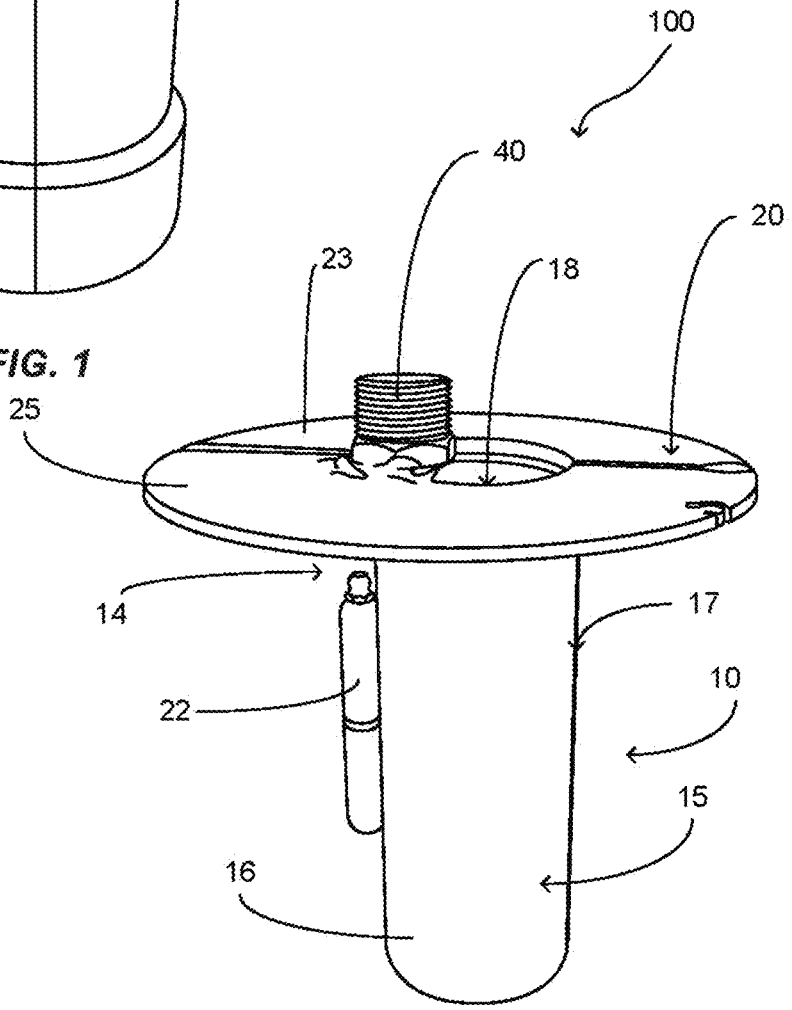
FIG. 2 is a perspective view of the present invention.

Referring now to the drawings submitted herewith, wherein various elements depicted therein are not necessarily drawn to scale and wherein through the views and figures like elements are referenced with identical reference numerals, there is illustrated a drain auger cleaning device 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the drain auger cleaning device 100 is manufactured from a durable rigid material such as but not limited to metal. It is contemplated within the scope of the present invention that the drain auger cleaning device 100 could be manufactured in various sizes so as to be operably inserted into drain pipes and plumbing cleanout of alternate diameters.

The drain auger cleaning device 100 includes a body 10 wherein the body 10 has a lower portion 15 and an upper portion 20 that are integrally formed. The lower portion 15 and upper portion 20 are operably coupled utilizing suitable techniques such as but not limited to welding. The lower portion 15 is cylindrical in shape and is comprised of a first section 16 and second section 17. The first section 16 and second section 17 are identically shaped each being semi-circular and comprise the lower portion 15 wherein the lower portion 15 has a hollow passage 18 extending therethrough. The first section 16 and second section 17 of the lower portion 15 are hingedly coupled with hinge member 22. The body 10 of the drain auger cleaning device 100 is configured to be hingedly opened and closed wherein the hingedly opening of the body 10 facilitates an ability to surroundably mount a drain auger 99. The drain auger 99 enters the hollow passage 18 through opening 13 and allows inward and outward movement of the drain auger 99 ensuing closing of the body 10 to its closed position and insertion into an exemplary cleanout 98. It is contemplated within the scope of the present invention that the lower portion 15 could be manufactured in various lengths and diameters. It is further contemplated within the scope of the present invention that the lower portion 15 of the body 10 could be a solid cylindrical piece manufactured to various sizes to be inserted into a mateable sized cleanout 98.

Figure 3:
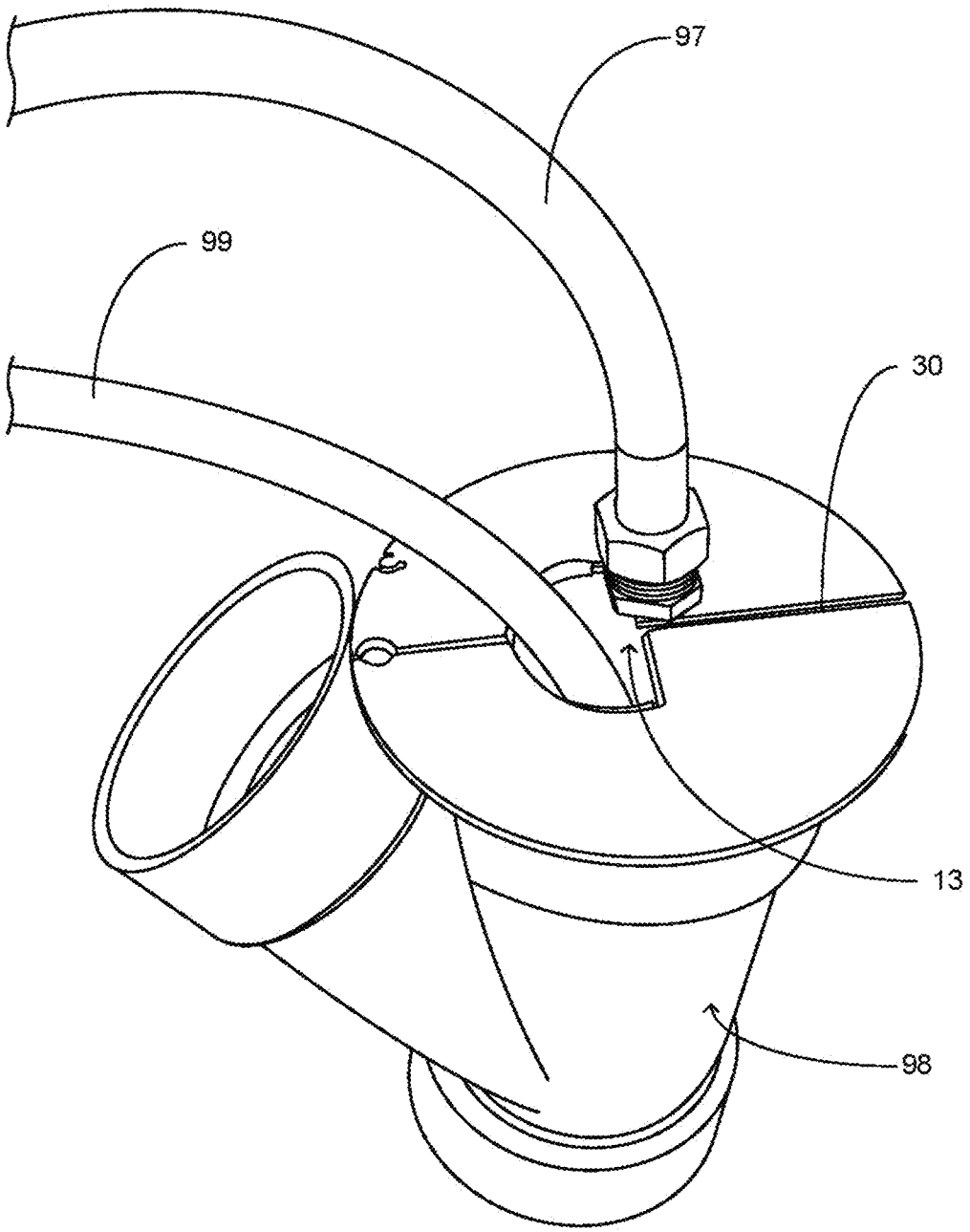
FIG. 3 is a top perspective view of the present invention inserted into an exemplary plumbing cleanout.

The upper portion 20 of the body 10 is operably coupled to the upper end 14 of the lower portion 15 being perpendicular thereto. The upper portion 20 has a diameter greater than that of the lower portion 15 facilitating an ability for the drain auger cleaning device 100 to be placed on plumbing cleanout 98 as illustrated herein in FIG. 3. The upper portion 20 is comprised of a first section 23 and a second section 25. First section 23 of the upper portion 20 is integrally formed with the first section 16 of the lower portion 15 of the body 10. The second section 25 of the upper portion 20 is integrally formed with the second section 17 of the lower portion 15. The first section 23 and second section 25 are separated at center seam 30. The first section 23 and second section 25 move in conjunction with the first section 16 and second section 17 during hingedly moving the body 10 between its open and closed position. Ensuing the body 10 being placed in the closed position the opening 13 is surroundably mounted to the drain auger 99.

Secured to the upper portion 20 is water inlet 40. Water inlet 40 facilitates an operable connection of the drain auger cleaning device 100 with a water hose 97. The water inlet 40 is operably coupled adjacent the opening 13 utilizing suitable techniques and provides an introduction of water into the opening 13 and hollow passage 18. It should be understood within the scope of the present invention that the water inlet could be a male or female fitting in order to facilitate coupling with a water hose 97. It should be further understood within the scope of the present invention that the water inlet could be provided in alternate sizes in order to couple to alternate sizes of hoses.

The drain auger cleaning device 100 includes keepers 60 wherein the keepers 60 include a first portion 62 and a second portion 64. The keepers 60 are operable to releasably secure the drain auger cleaning device 100 within exemplary pipe 96 or the cleanout 98. The second portion 64 is secured to the bottom surface 19 of the upper portion 20 of the body 10. The second portion 64 is secured utilizing suitable techniques such as but not limited to welding. The first portion 62 is rotatably movable within the second portion 64 facilitating an inward-outward motion of the first portion 62 so as to bias against the pipe 96 maintaining the position of the drain auger cleaning device 100 ensuing being operably coupled with the pipe 96. The keepers 60 are located diametrically opposed from each other with respect to the pipe 96. While the drawings submitted herewith illustrate two keepers 60, it is contemplated within the scope of the present invention that the drain auger cleaning device 100 could employ more or less than two keepers 60. Additionally, it is contemplated within the scope of the present invention that the keepers 60 could be constructed in alternate manners and still achieve the desired objective discussed herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A drain auger cleaning device configured to clean a drain auger as the drain auger is being removed from the cleaning device wherein the drain auger cleaning device is comprised of:

a body, said body having a lower portion and an upper portion, said lower portion having a hollow passage extending therethrough, said lower portion being cylindrical in shape, said lower portion having a lower end and an upper end, said upper portion being secured to said lower portion at said upper end thereof, said upper portion being annular in shape and planar in manner, said upper portion having a diameter that is greater than that of a diameter of the lower portion, said body having an opening at an upper end thereof providing access to the hollow passage;

a water inlet, said water inlet being operably coupled to said upper portion proximate said opening of said body, said water inlet configured to be operably coupled to a water source so as to introduce water into the hollow passage of said body.

2. The drain auger cleaning device configured to clean a drain auger as the drain auger is being removed from the cleaning device as recited in claim 1, wherein said lower portion of said body includes a first section and a second section, said first section and said second section being semicircular in shape.

3. The drain auger cleaning device configured to clean a drain auger as the drain auger is being removed from the cleaning device as recited in claim 2, wherein said first section and said second section of said lower portion of said body are operably coupled with a hinge member.

4. The drain auger cleaning device configured to clean a drain auger as the drain auger is being removed from the cleaning device as recited in claim 3, wherein said hinge member is configured to move said first section and said second section of said lower body between an open and closed position.

5. The drain auger cleaning device configured to clean a drain auger as the drain auger is being removed from the cleaning device as recited in claim 4, wherein said upper portion includes a first section and a second section being of equal size having a center seam providing separation thereof.

6. The drain auger cleaning device configured to clean a drain auger as the drain auger is being removed from the cleaning device as recited in claim 5, wherein said first section of said upper portion is secured to said first section of said lower portion.

7. The drain auger cleaning device configured to clean a drain auger as the drain auger is being removed from the cleaning device as recited in claim 6, wherein said second section of said upper portion is secured to said second section of said lower portion.

8. The drain auger cleaning device configured to clean a drain auger as the drain auger is being removed from the cleaning device as recited in claim 7, wherein said water inlet is configured to be either a male or female plumbing fitting.

9. The drain auger cleaning device configured to clean a drain auger as the drain auger is being removed from the cleaning device as recited in claim 8, and further including at least one keeper, said at least one keeper having a portion thereof secured to a lower surface of said upper portion, said at least one keeper configured to releasably secure the body within a pipe or plumbing cleanout.

10. The drain auger cleaning device configured to clean a drain auger as the drain auger is being removed from the cleaning device as recited in claim 9, wherein the opening of said body is configured to facilitate the drain auger being journaled thereinto so as to enter the hollow passage of the body.

* * * * *